US005989014A

United States Patent [19]

Invernizzi

[11] Patent Number: 5,989,014

[45] Date of Patent: Nov. 23, 1999

[54] DEVICE FOR SUPPLYING A GAS-AIR MIXTURE TO BURNERS IN HEATING APPARATUSES

[76] Inventor: Gianmario Invernizzi, Via Montessori, 22053 Lecco, Italy

[21] Appl. No.: 08/885,357

[22] Filed: Jun. 30, 1997

[30] Foreign Application Priority Data

Oct. 3, 1996 [EP] European Pat. Off. ..... 96830506

[51] Int. Cl.[6] ..... F23D 14/14; F04B 17/00

[52] U.S. Cl. ..... 431/328; 431/7; 431/354

[58] Field of Search ..... 431/354, 326, 431/328, 12, 7

[56] References Cited

U.S. PATENT DOCUMENTS

| | | | |
|---|---|---|---|
| 3,307,529 | 3/1967 | Fannon, Jr. et al. | 431/328 |
| 4,737,102 | 4/1988 | Jinno et al. | 431/328 |
| 5,261,812 | 11/1993 | Javet et al. | 431/328 |

FOREIGN PATENT DOCUMENTS

| | | | |
|---|---|---|---|
| 110 685 | 1/1975 | Germany . | |
| 40 11 691 A1 | 10/1990 | Germany . | |
| 44 43 045 | 6/1995 | Germany . | |
| 402169920 | 6/1990 | Japan | 431/328 |

*Primary Examiner*—Carl D. Price

*Attorney, Agent, or Firm*—Robert F. I. Conte; Lee, Mann, Smith, McWilliams, Sweeney & Ohlson

[57] ABSTRACT

The device comprises a ventilation unit (4) connected with a gas-supplying valve unit (10) via a mixing duct (11). The fixed structures of the ventilation unit (4) and gas-supplying unit (10) and of the mixing duct (11) are of one piece construction (20), so as to give the device (1) an excellent structural compactness, which will make it adaptable to different types of burners (3) and boilers (2).

13 Claims, 5 Drawing Sheets

DEVICE FOR SUPPLYING A GAS-AIR MIXTURE TO BURNERS IN HEATING APPARATUSES

BACKGROUND OF THE INVENTION

1. Field of the Invention

The present invention relates to a device for supplying a gas-air mixture to burners in heating apparatuses, comprising: a ventilation unit provided with a fan wheel operatively engaged in a fixed box-shaped portion having an inlet opening communicating with the external environment and an outlet opening to be connected with a burner, a gas-supplying valve unit comprising drive means operating on at least one valve seat to selectively open the gas passage through the valve seat itself, a mixing duct bringing the valve unit into fluid communication with the ventilation unit.

In particular the device in question is such conceived as to be advantageously utilized in heat-supplying boilers for household use. However application of the invention to heating apparatuses of different kinds may be provided.

2. Prior Art

It is known that heating apparatuses for household use such as boilers, water heaters and the like generally comprise a burner at the outlet opening of which an air-gas mixture fed through the burner itself is fired to produce the necessary heat for heating the water contained in appropriate accumulators and/or heat exchangers.

In apparatuses equipped with a burner of the pre-mixed type, the air-gas mixture is formed upstream of the burner, by cooperation between an air-feeding unit generally consisting of a centrifugal fan, and a gas-supplying valve unit. The ventilation and gas-supplying units are mutually interconnected by a connecting duct that, depending on the applications, can be located upstream or downstream of the ventilation unit and they are driven by an electronic control unit managing operation thereof depending on the requirements dictated by different operating parameters suitably controlled by the electronic control unit itself.

All that being stated, it is to point out that presently the ventilation unit and gas-supplying valve unit, as well as the electronic control unit, are accomplished as units completely distinct from each other, each of which is installed in a specific space expressly arranged for it within the holding structure of the boiler or other heating apparatus. This solution has been always deemed capable of offering a good project freedom to the heating apparatus manufactures, due to the possibility of managing the individual modules in an independent manner in the available spaces within the apparatuses themselves. However, it has now been realized that while managing of the ventilation unit, gas-supplying unit and control unit as distinct and separated modules appears to be advantageous under the point of view of freedom in planning, it actually brings about different drawbacks, among which stock managing of the individual modules is of great importance.

Difficulties are also encountered by the heating apparatus manufacturers in carrying out the planning management of the separated modules. These difficulties are further increased by the fact that, in most cases, the ventilation, gas-supplying and control units employed on a given apparatus do not come from one and the same manufacturer, but from different manufacturers, each skilled in a specific field. The heating apparatus designer therefore, must exactly know all operating parameters of each individual unit in order to verify and ensure the perfect compatibility between the different modular units even when subsequent adaptations are carried out.

It is also to point out that the fact itself that the units are accomplished as distinct and separate modules involves an increase in the overall production costs.

SUMMARY OF THE INVENTION

The main aim of the present invention is to solve the problems of the known art by providing a feed device incorporating the ventilation, gas-supplying and control units into a single structure.

Within the scope of this main aim, it is an object of the present invention to find out technical solutions capable of giving the device in reference a structure of such a reduced bulkiness that incorporation of the three units into a single device does not involve any planning constraint in terms of bulkiness, as one would be presently inclined to believe, said single device on the contrary, surprisingly simplifying all problems related to the installation of the means intended for carrying out the supply of burners.

The foregoing and further objects that will become more apparent in the course of the present description are substantially achieved by a device for supplying an air-gas mixture to burners in heating apparatuses, wherein said mixing duct is defined by an auxiliary box-shaped portion of flattened conformation peripherally projecting from the fixed box-shaped portion of the ventilation unit in a median plane substantially parallel to a median lying plane of said ventilation unit, said at least one valve seat being formed in a bottom wall of the auxiliary box-shaped structure carrying said drive means of the gas-supplying valve unit.

BRIEF DESCRIPTION OF THE DRAWINGS

Further features and advantages will become more apparent from the detailed description of a preferred embodiment of a device for supplying burners for heating apparatuses with an air-gas mixture in accordance with the present invention. This description is taken hereinafter with reference to the accompanying drawings, given by way of non-limiting example, in which.

DESCRIPTION OF THE PREFERRED EMBODIMENT

Figure 1:
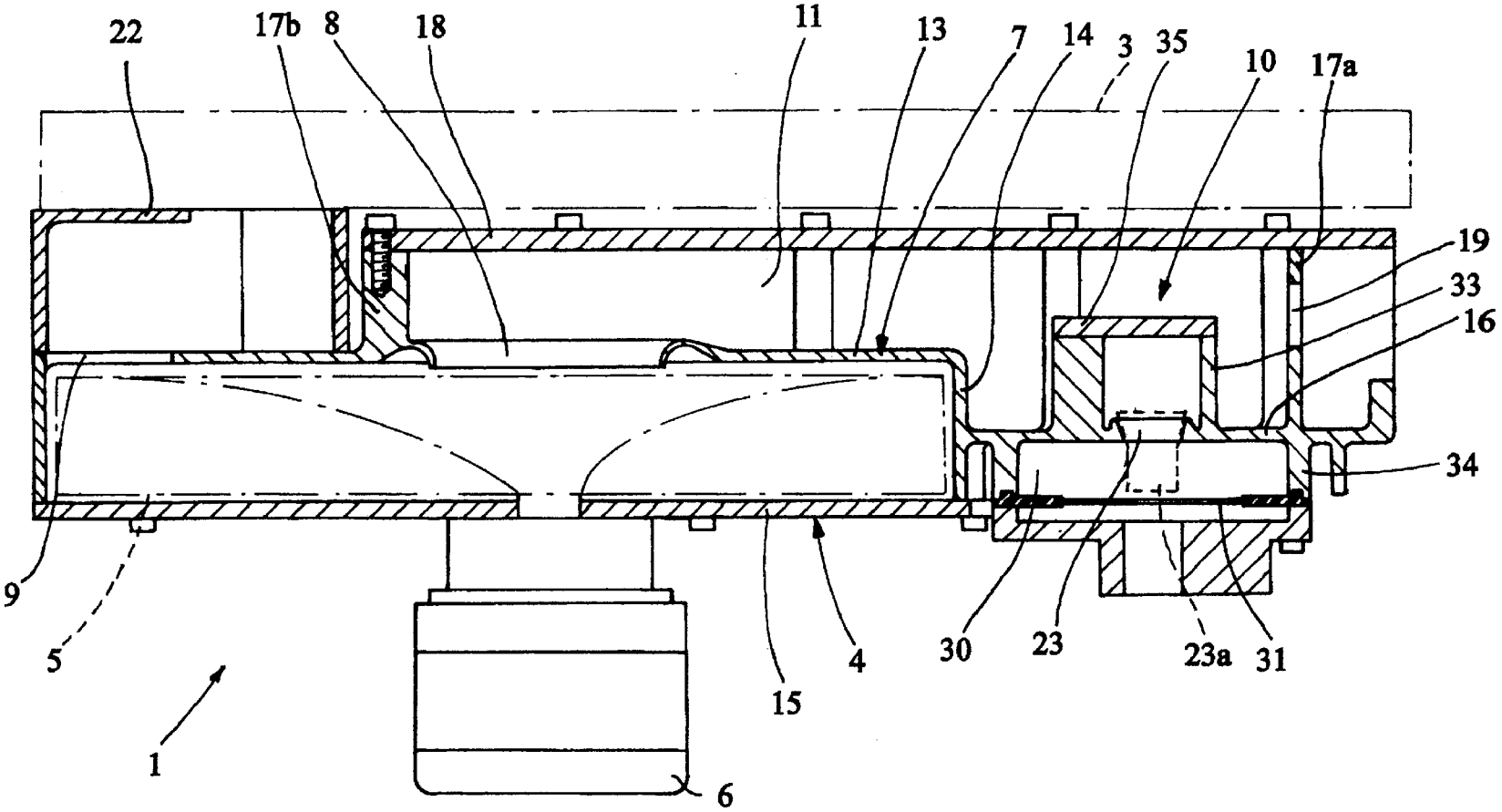
FIG. 1 is a sectional view of the device in question taken along line I—I in FIG. 2.

With reference to the drawings, a device for supplying burners of heating apparatuses with an air-gas mixture in accordance with the present invention has been generally identified by reference numeral 1.

In the embodiment shown the device 1 is conceived for being associated with a heat-supplying boiler for household use 2, equipped with a heat exchanger 2*a* inside which water is circulated, said water being heated by a burner 3 supplied with an air-gas mixture by the device itself.

The device 1 comprises a ventilation unit 4 in turn comprising a fan wheel 5 driven by a motor 6 and operating within a fixed box-shaped portion 7 having a flattened box-shaped conformation.

In the embodiment shown the fan wheel 5 is of the centrifugal type, is adapted to suck in air through an inlet opening 8 formed in the fixed box-shaped portion 7 and communicating with the surrounding atmosphere, so as to send said air to the burner 3 through an outlet opening 9 arranged in the fixed box-shaped portion 7 at a peripheral position with respect to the fan wheel 5.

The ventilation unit is put into fluid communication with a gas-supplying valve unit 10, by a connecting duct 11. In a manner known per se the valve unit 10 is adapted to selectively supply gas to a measured amount depending on requirements, as better clarified in the following.

The mixing duct 11 is advantageously defined by an auxiliary box-shaped portion 12 of a flattened conformation, peripherally projecting from the fixed box-shaped portion 7 of the ventilation unit 4, in a median plane substantially parallel to the median lying plane of the fixed box-shaped portion 7.

Figure 3:
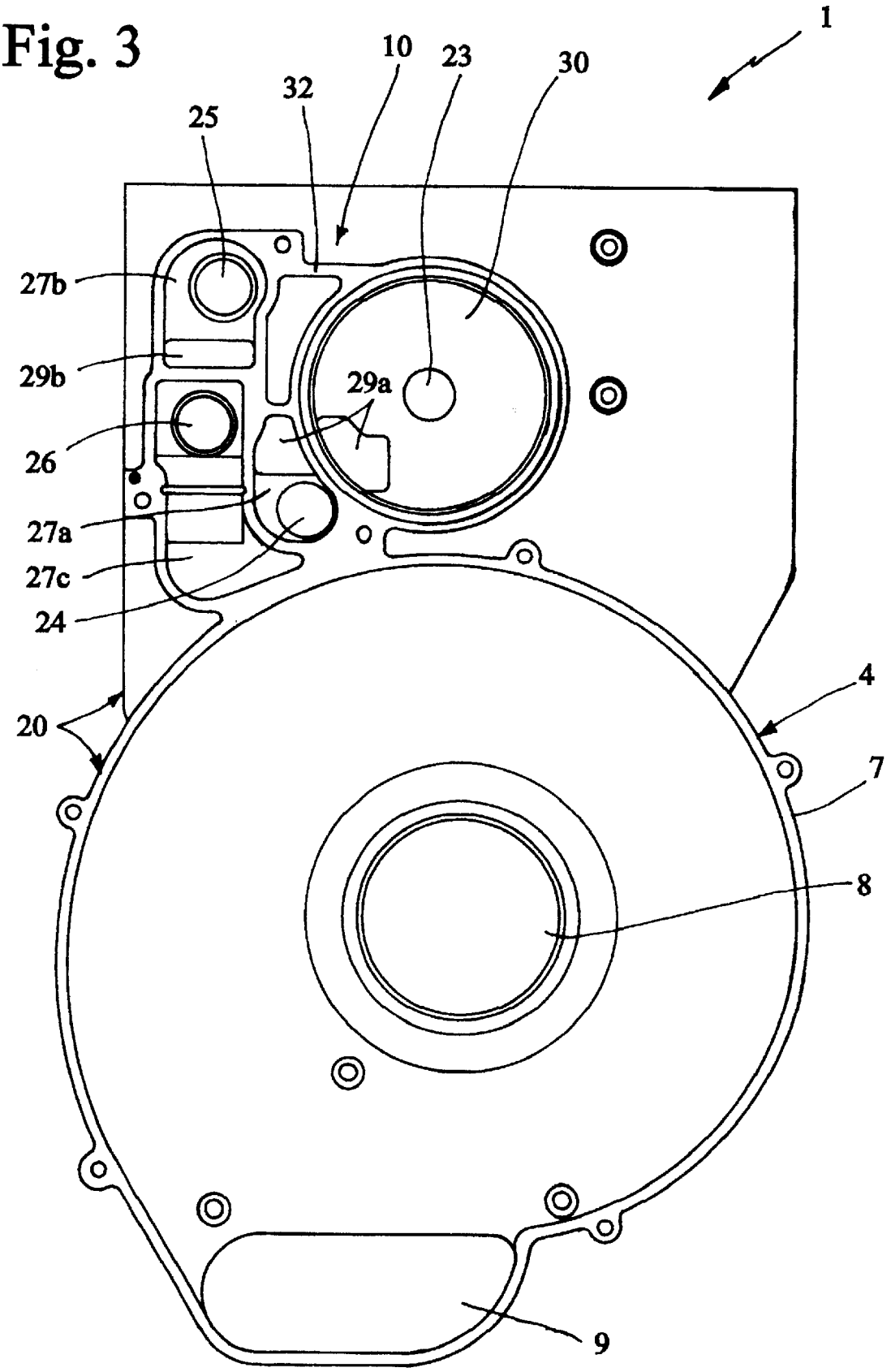
FIG. 3 shows the bearing structure seen from the opposite side in respect of FIG. 2.
Figure 4:
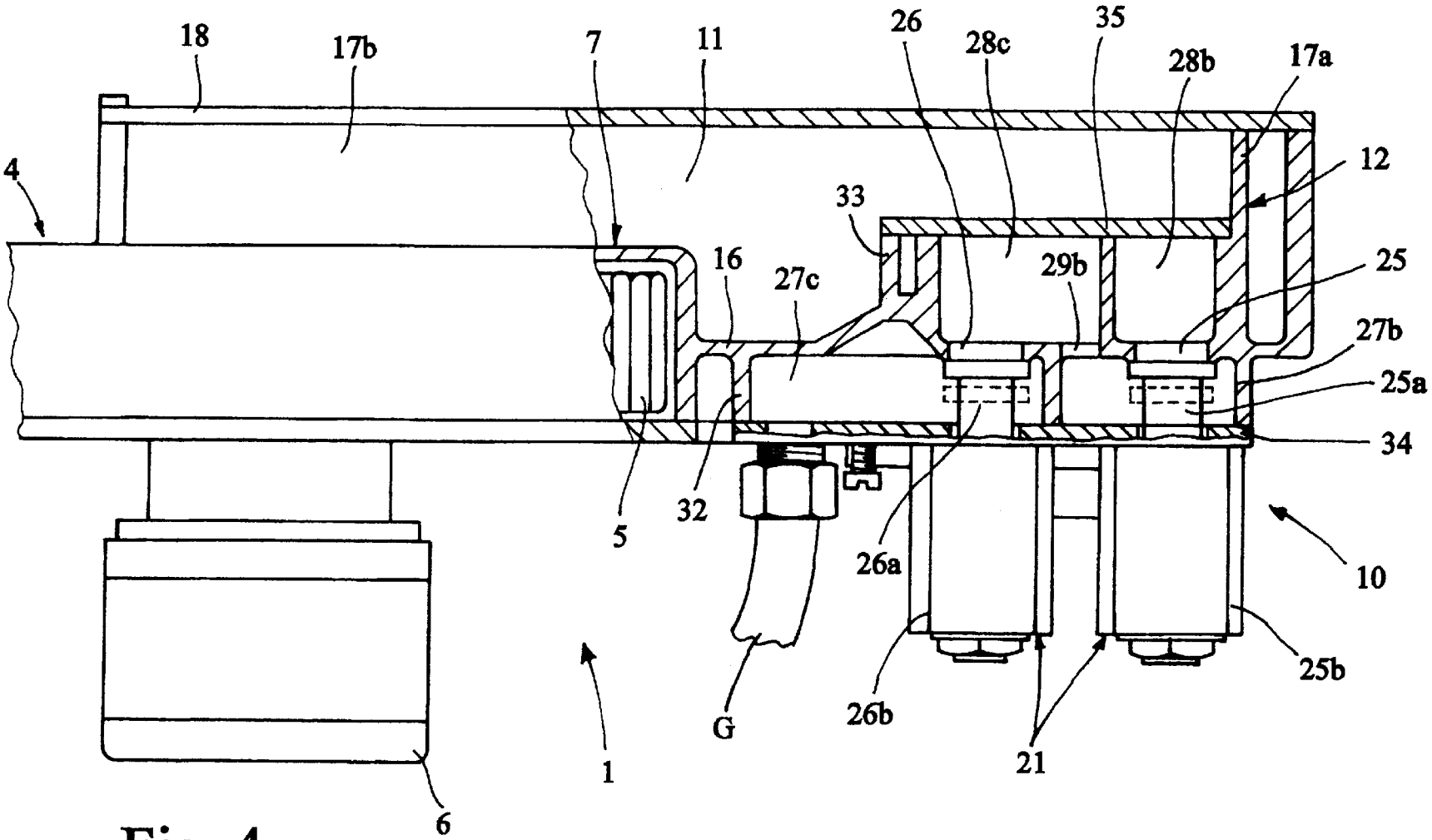
FIG. 4 is a fragmentary sectional view taken along line IV—IV in FIG. 2.

Preferably the fixed box-shaped portion 7 of the ventilation unit 4 is essentially comprised of a base wall 13 in which the inlet and outlet openings 8, 9 are formed and peripherally provided with at least one perimetric bordering wall 14. Removably in engagement with the perimetric bordering wall 14 is a first plate-like closing element (not shown in FIG. 3) with which the motor 6 for operation of the fan wheel 5 is associated.

Figure 2:
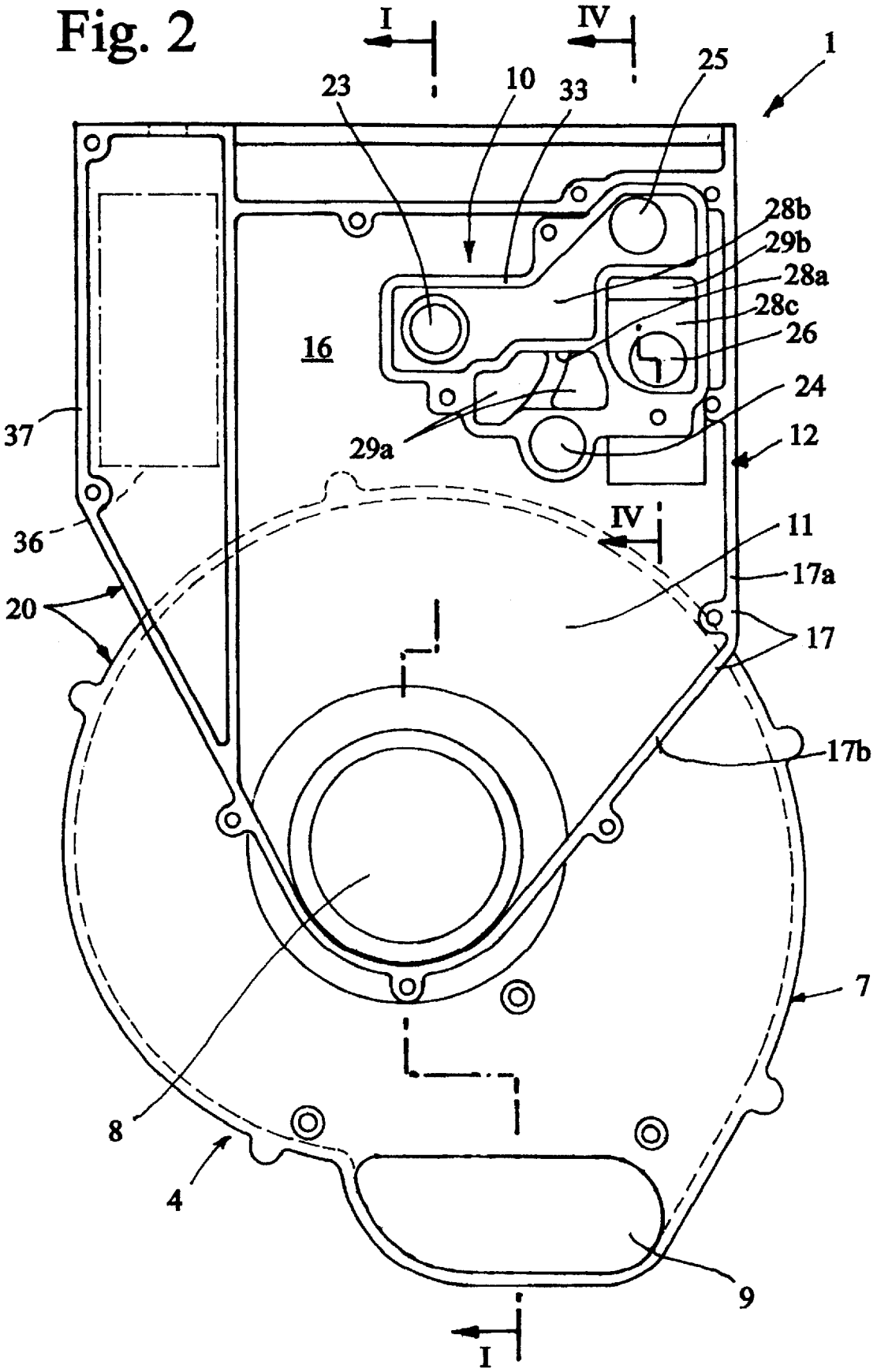
FIG. 2 is a plan view of a bearing structure of the device.

The auxiliary box-shaped portion 12 in turn has a bottom wall 16 integrally carrying at least one auxiliary rim 17 with which a second plate-like closing element 18 (not shown in FIG. 2) is removably in engagement. Said second closing element 18 extends parallelly to the bottom wall so as to confine the mixing duct 11 with respect to the surrounding atmosphere. More particularly, defined along the perimetric extension of the auxiliary rim 17 is a main portion 17*a* directly projecting from the bottom wall 16 and an additional portion 17*b* projecting outwardly from the base wall 13 of the fixed box-shaped portion 7 so as to circumscribe the inlet opening 8 of the ventilation unit 4. In this manner the ventilation unit 4 is arranged to take in air directly from the mixing duct 11, in turn communicating with the surrounding atmosphere through a gauged opening 19 provided in the main portion 17*a* of the auxiliary rim 17 on the opposite side from the ventilation unit 4.

Advantageously, each of the fixed and auxiliary box-shaped portions 7 and 12, substantially perpendicular to the rotation axis of the fan wheel 5, are unitary with each other, except for the respective removable closing elements 15, 18, so as to substantially define a monolithic support body 20 of substantially flattened configuration which advantageously can be made by a single operation involving aluminum die-casting.

The gas-supplying valve unit 10 essentially comprises drive means 21 operating on one or more valve seats 23, 24, 25, 26 through which at least one gas-feeding pipe "G" is brought into communication with the mixing duct 11. In accordance with the present invention the valve seat or seats 23, 24, 25, 26 are formed in the bottom wall 16 of the auxiliary box-shaped portion 12 to which the drive means 21 is also connected.

More particularly, the drive means 21 is advantageously fastened, as shown in the accompanying drawings, to one side of the bottom wall 16 which is external to the mixing duct 11. This external side is advantageously facing away from the external side of the base wall 13 so that the drive valve means 21 is located on the same side as motor 6, with respect to the monolithic body 20. By virtue of the above, the monolithic body 20 on the opposite side from motor 6 and the drive means 21 has a free side completely available for placement of burner 3, irrespective of the geometric and dimensional features of said burner. Interconnection between the burner 3 and the monolithic body 20 of the device 1 can advantageously take place by interposition of at least one interchangeable union element 22 specifically adapted to the type of burner installed in the boiler 2 and with which the device 1 is to be associated.

In a preferential embodiment, the gas-supplying valve unit 10 has a plurality of valve seats 23, 24, 25, 26 mutually interconnected by a labyrinth-like path essentially formed of outer stretches 27*a*, 27*b*, 27*c* and inner stretches 28*a*, 28*b*, 28*c*, consecutively interconnected with each other by passage openings 29*a*, 29*b* formed in the bottom wall 16.

In more detail, a primary valve seat 23 is provided at which a vacuum chamber 30 is formed. Said vacuum chamber 30 is connected to the mixing duct 11 through an admission valve seat 24 arranged to receive a flow-rate-adjusting nozzle (not shown). The admission seat 24 in turn communicates with the vacuum chamber 30 via a pair of first passage openings 29*a* interconnecting a first outer stretch 27*a* with a first inner stretch 28*a* of the labyrinth-like path.

Associated with the vacuum chamber 30 is a pressure-detecting diaphragm 31 that, against the action of spring means not shown, acts on a primary closure member 23*a* operating on the primary valve seat 23. The diaphragm surface facing towards the inside of the vacuum chamber is subjected to pressure variations produced in the chamber 30 itself by effect of the vacuum created in the mixing duct 11 upon the action of the fan wheel 5, the value of said vacuum varying depending on the rotational speed imposed to said wheel. The diaphragm 31 surface opposed to the vacuum chamber 30 is instead subjected to a reference pressure corresponding to the atmospheric pressure, for example. under this situation the vacuum created in the mixing duct 11 upon effect of the fan wheel 5 causes deformation of the diaphragm 31 and consequently opening of the primary valve seat 23 by the corresponding primary closure member 23a, to a more or less important degree depending on the vacuum amount.

On the opposite side from the vacuum chamber 30, the primary valve seat 23 communicates with a first shutoff valve seat 25 through a second inner stretch 28*b* of the labyrinth-like path. Said first shutoff valve seat 25 is in turn connected with a second shutoff valve seat 26 through a second outer stretch 27*b* and a third inner stretch 28*c* of the labyrinth-like path, mutually interconnected by a second passage opening 29*b*. A gas-admitting pipe union connected to said feeding pipe "G" is connected to the second shutoff valve seat 26 via a third outer stretch 27*c* of the labyrinth-like path. Combined with the first and second shutoff valve seats 25, 26 are respective shutoff closure members 25*a*, 26*a*, driven by corresponding electromagnets 25*b*, 26*b* to selectively open and close the gas inflow to the primary valve seat 23.

The individual outer and inner stretches 27*a,b,c*, and 28*a,b,c* of the labyrinth-like path as well as the vacuum chamber 30 are delimited by outer and inner bordering ribs 32, 33 formed in one piece with the bottom wall 16 and projecting outwardly and inwardly of the mixing duct 11, respectively. The outer stretches 27*a,b,c* and the vacuum chamber 30 (not shown in FIG. 3) are isolated from the external environment by a support element 34 fastened to the outer side of the bottom wall 16 and acting on the end edges of the outer bordering ribs 32. Mounted to said support element 34 are all members being part of the drive means 21, except for the valve seats 23, 24, 25, 26, and the vacuum chamber 30 and, more generally, except for that which has been directly formed in the structure of the monolithic body 20. The inner stretches 28 of the labyrinth-like path are in turn isolated from the mixing duct 11 by an auxiliary plate-like closing element 35 (not shown in FIG. 2) sealingly fixed to the edges of the inner bordering ribs 33.

Operation of the device 1 is managed by an electronic control unit 36, only diagrammatically shown in that known per se, which is advantageously housed in a third box-shaped portion 37 integral with the monolithic body 20. The third box-shaped portion 37 can be, depending on each individual case, either made at least partly of one piece construction with the monolithic body 20, or fastened to the monolithic body by snug-fitting connecting means or other means.

In a manner known per se, the electronic control unit 36 is connected to several sensors suitably installed in the boiler 2 to detect given operating parameters (e.g. the water temperature, environmental temperature or others), based on which supply of the air-gas mixture to burner 3 is to be suitably adjusted.

In particular, depending on these parameters, the electronic unit 36 drives opening of the shutoff valve seats 25, 26 by the respective closure members 25*a*, 26*a*, as well as operation of the fan wheel 5 to a given speed. Based on the rotational speed of the fan wheel 5 the vacuum consequently produced in the mixing duct 11 is transmitted to the vacuum chamber 30, thereby causing opening of the primary valve seat 23 to a more or less important extent depending on the operation speed of the fan wheel 5.

The gas outflowing through the primary valve seat 23 therefore can reach the mixing duct 11 via the admission valve seat 2 and, as a result, mix with the air taken in through the gauged opening 19.

The present invention achieves the intended purposes.

By virtue of the proposed innovatory solutions, the device in question is adapted to incorporate the ventilation unit, the gas-supplying valve unit and the electronic control unit into a single and very compact structure, overcoming all constraints that had hitherto suggested accomplishment and management of these units in a completely distinct and independent manner, allocating a specific space within the boiler structure to each of them. Due to the flattened conformation of the monolithic body and, more generally, the structural compactness of the device in question, placement of said device within the structure of any type of boiler is made much easier. In addition, due to the arrangement of a completely free side portion in front of the monolithic body 20, on the opposite side from the drive means of the valve unit and the motor of the ventilation unit, the device in reference can be coupled with any type of burner in a very easy manner and its positioning within the boiler can find an appropriate adaptation.

Figure 6:
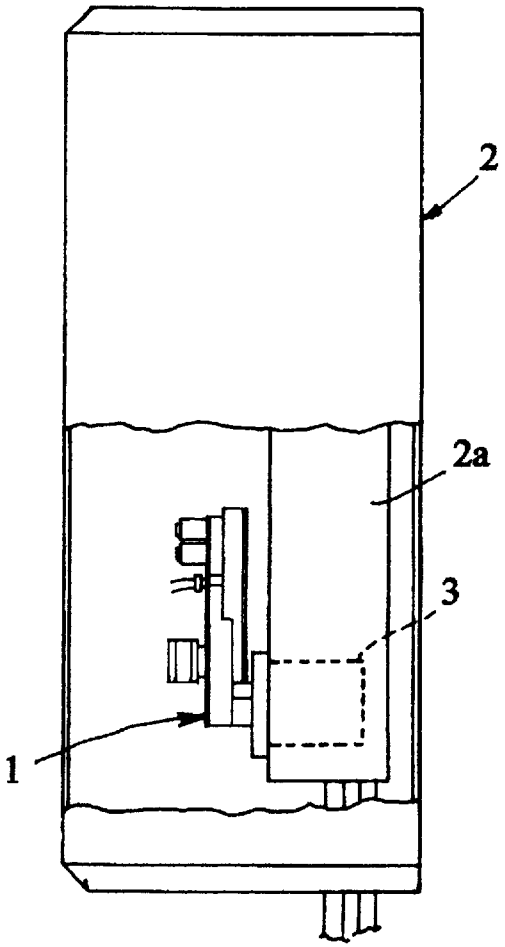
FIGS. 5 and 6 diagrammatically show the device in question mounted on a boiler in combination with burners of different typologies.
Figure 5:
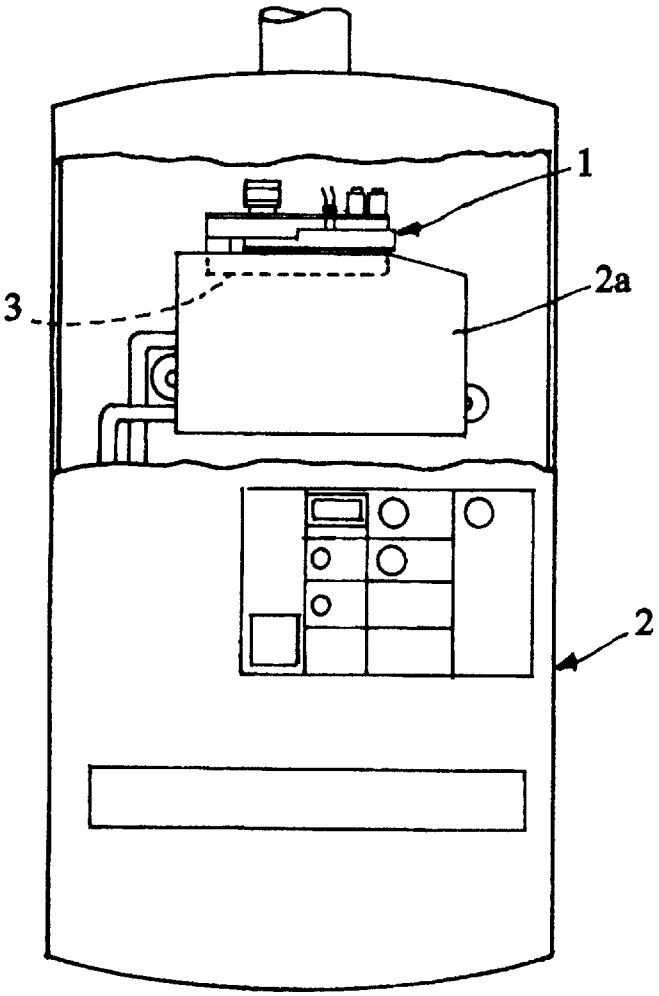

FIGS. 5 and 6 show, by way of example only, two different modalities of placement of the device 1 within the boiler 2 depending on the different type of burner 3 employed.

In the case of FIG. 5, the burner 3 is of the plate-like type with a radiating surface turned downwardly and the device 1 has the monolithic body 20 disposed in a substantially horizontal plane above the burner itself. In the case shown in FIG. 6, where a cylindrical-head burner is used which is located sideways in the boiler 2 structure, the monolithic body 20 is placed in a substantially vertical plane.

It is also to note that the invention achieves important advantages in terms of economical manufacturing costs too. In fact, the monolithic body 20 obtained by a pressing step incorporates into its own structure, the fixed box-shaped portion 7 of the ventilation unit 4, the auxiliary box-shaped portion 12 defining the mixing duct 11, all the valve seats and the labyrinth-like path being part of the gas-supplying valve unit 10, as well as the third box-shaped portion 37. This represents a clear advantage as compared with the known solutions in which the support and holding structures for the individual ventilation unit, gas-supplying unit and electronic control unit needed to be made separately from each other and individually fastened to the boiler structure.

It is also to note that by virtue of the invention the boiler designers or manufacturers can have at their disposal a device that can be easily adapted to any type of boiler being produced, in which the individual ventilation, gas-supplying and control units are planned and calibrated so as to be integrated with each other. In other words, the boiler designer is no longer entrusted with the task of selecting ventilation units and gas-supplying units that are compatible with each other and producing suitably conceived control units, adapted to manage said ventilation and gas-supplying units or make them compatible with each other.

What is claimed is:

1. A device for supplying a gas-air mixture to burners in heating apparatuses, comprising:

a ventilation unit (4) provided with a fan wheel (5) rotatable about a rotation axis and a fixed box-shaped portion (7) operatively engaging the ventilation unit (4) and having an inlet opening (8) communicating with the external environment and an outlet opening (9) to be connected with a burner (3);

a gas-supplying valve unit (10) comprising at least one valve seat and drive means (21) operating on said at least one valve seat (23, 24, 25, 26) to selectively open a gas passage through the at least one valve seat itself;

a mixing duct (11) communicating with the valve unit and the ventilation unit for bringing the valve unit (10) into fluid communication with the ventilation unit (4);

wherein said mixing duct (11) is defined by an auxiliary box-shaped portion (12) of flattened conformation projecting from the fixed box-shaped portion (7) of the ventilation unit (4), said auxiliary box-shaped portion being flattenend according to a median plane substantially perpendicular to the rotation axis of the fan wheel, and exhibiting a bottom wall carrying said at least one valve seat (23, 24, 25, 26) and said drive means (21) of the gas-supplying valve unit (10).

2. The device as claimed in claim 1, comprising a monolitic support body (20) defined by said auxiliary box-shaped portion (12) and the fixed box-shaped portion (7) of the ventilation unit (4) joined to each other in one piece.

3. The device as claimed in claim 1, wherein said fixed box-shaped portion (7) substantially is flattened according to a plane perpendicular to the rotation axis of said fan wheel (5).

4. The device as claimed in claim 1, wherein the fixed box-shaped portion (7) of the ventilation unit (4) comprises a base wall (13) provided with at least one perimetric bordering wall (14), as well as a first closing element (15) removably in engagement with said at least one perimetric bordering wall (14).

5. The device as claimed in claim 4, wherein said drive means (21) is fastened to an outer side of the bottom wall (16) facing away from an outer side of the base wall (13).

6. The device as claimed in claim 4, wherein a motor for operation of the fan wheel (5) is associated with said first closing element (15).

7. The device as claimed in claim 4, wherein the outlet opening (9) is formed in the base wall (13) of the fixed box-shaped portion (7) at a peripheral position relative to said fan wheel (5).

8. The device as claimed in claim 1, further comprising at least one interchangeable union element (22) engaged to the outlet opening (9) of the ventilation unit (4) for connectin it to the burner (3).

9. The device as claimed in claim 1, wherein the auxiliary box-shaped portion (12) comprises at least one second closing element (18) extending parallelly to the bottom wall (16) and detachably fixed to an auxiliary rim (17) integral with the bottom wall to delimit the mixing duct (11).

10. The device as claimed in claim 9, wherein the auxiliary rim (17) comprises a main portion (17*a*) projecting from said bottom wall (16) and an additional portion (17*b*) projecting outwardly from the base portion (13) of the fixed box-shaped portion (7) to circumscribe the inlet opening (8) of the ventilation unit (4).

11. The device as claimed in claim 1, comprising a plurality of valve seats (23, 24, 25, 26) interconnected with each other by outer stretches (27 *a, b, c*) and inner stretches (28 *a, b, c*) consecutively interconnected by passage openings (29) formed in said bottom wall (16), said outer and inner stretches being delimited by outer and inner bordering ribs (32) (33) formed in one piece with the bottom wall (16) and projecting outwardly and inwardly of the mixing duct (11) respectively.

12. The device as claimed in claim 11, wherein said drive means (21) is carried by a support element (34) fastened to an outer side of the bottom wall (16) and acting on the outer bordering ribs (32) to isolate the outer stretches (27 *a, b, c*) from the external environment.

13. The device as claimed in claim 11, further comprising at least one auxiliary closing element (35) fixed to the inner bordering ribs (33) to isolate the inner stretches (28 *a, b, c*) from the mixing duct (11).

* * * * *